United States Patent [19]

Gubbe et al.

[11] 4,421,035

[45] Dec. 20, 1983

[54] APPARATUS FOR LOCKING A KEYBOARD AT SELECTED INCLINATIONS TO A HORIZONTAL REFERENCE

[75] Inventors: Bernd Gubbe, Nuremberg; Klaus-Dieter Krause, Oberasbach; Otto Schonemann, Furth; Rudolf Neidhardt, Nuremberg, all of Fed. Rep. of Germany

[73] Assignee: Triumph-Adler A.G. fur Buro-und Informationstechnik, Nuremberg, Fed. Rep. of Germany

[21] Appl. No.: 254,124

[22] Filed: Apr. 14, 1981

[30] Foreign Application Priority Data

Apr. 15, 1980 [DE] Fed. Rep. of Germany ..... 3014325

[51] Int. Cl.[3] ..... A47F 5/12

[52] U.S. Cl. ..... 108/6; 248/454; 248/456

[58] Field of Search ..... 108/6; 248/456, 454, 248/242, 455; 5/74; 297/356

[56] References Cited

U.S. PATENT DOCUMENTS

| | | | |
|---|---|---|---|
| 186,487 | 1/1877 | Miltz | 5/74 |
| 663,582 | 12/1900 | Robbin | 297/356 |
| 773,720 | 11/1904 | Drury | 297/356 X |
| 1,836,053 | 12/1931 | Wagner | 248/456 |
| 1,896,965 | 2/1933 | Madden | 248/456 |
| 3,698,764 | 10/1972 | Geddings | 297/356 |
| 4,350,098 | 9/1982 | Shirouo et al. | 108/6 |

*Primary Examiner*—Francis K. Zugel
*Attorney, Agent, or Firm*—Joseph R. Spalla

[57] ABSTRACT

A keyboard is pivotally mounted on a pull out shelf to be raised from a reference position to desired angles of inclination within a range of angles, and is associated with apparatus for positively locking the keyboard following movement of the keyboard to a desired angle of inclination and its release; with the weight of the keyboard acting to maintain locking action. The apparatus effecting the locking action comprises a toothed segment whose arc and teeth define a range of angles. Associated with the toothed segment is a supporting arm biased to follow upward keyboard movement and on which the keyboard after being raised to a desired angle of inclination rests. Cooperating with the toothed segment is a pawl arranged to be deflected by the tooth segment as it follows the keyboard movement to a desired angle of inclination and upon release of the keyboard to engage with a tooth on the toothed segment to positively lock it under the weight of the keyboard thereby to establish the angle of inclination of the keyboard. To establish a lower angle of inclination from a higher angle of inclination, the keyboard and toothed segment are raised beyond the influence of the pawl and then lowered, with the pawl being cammed away by the lowering toothed segment.

4 Claims, 8 Drawing Figures

Fig_1
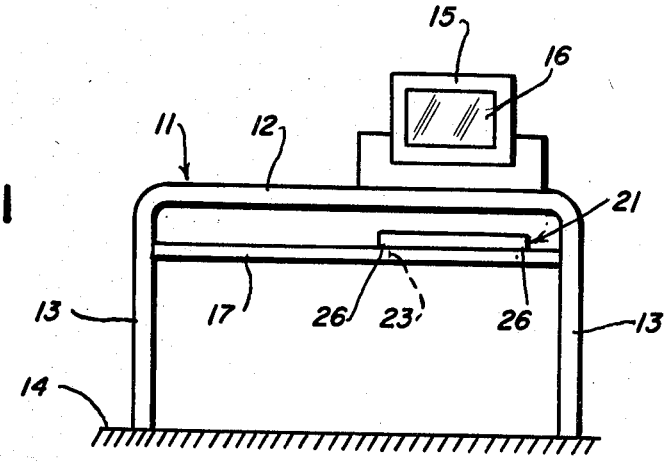
Fig_2
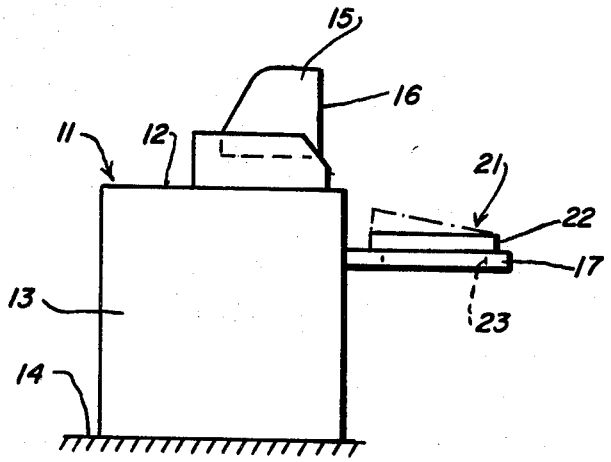
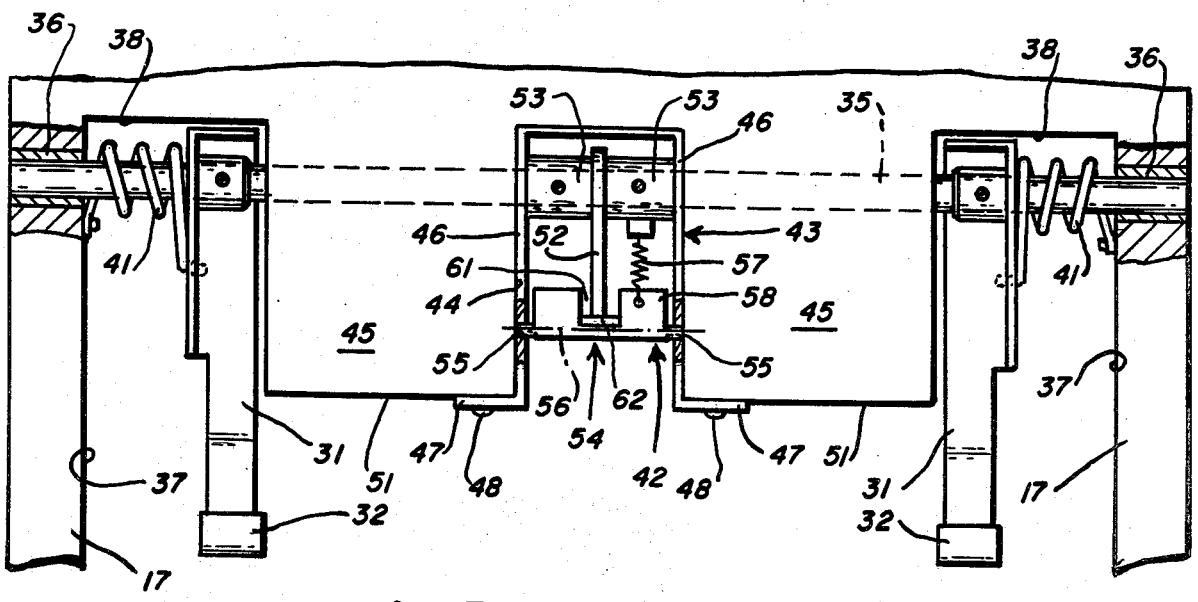
Fig_5

APPARATUS FOR LOCKING A KEYBOARD AT SELECTED INCLINATIONS TO A HORIZONTAL REFERENCE

This invention relates to mechanism for adjusting the inclination of a work station from the horizontal; more particularly it relates to mechanism having means which follows the movement of the work station to a desired angle of inclination and locks the work station against return movement back to the horizontal; and specifically it relates to such mechanism in which the locking means includes a toothed segment biased to follow work station movement to an inclined position and a pawl to engage with and positively lock the segment and supported work station in the selected inclined position.

It is known to arrange work surfaces so as to be inclinable about an essentially horizontal pivot axis; the work surface being maintained at a certain set inclination by means of clamping screws. Such mechanisms are difficult to adjust because the clamping screws must be tightened very firmly to achieve a sufficiently safe, frictional lock in a certain position of inclination. In turn, repositioning is very difficult because much force must be exerted to loosen the clamp connection.

Work surfaces as used herein are to be understood to include not only tops adjustable in their inclination, but any part with a surface on which work in any form is performed. Accordingly, the term work surface also includes keyboards or key panels associated with CRT display units.

In accordance with the invention a work surface, e.g. a keyboard, merely needs to be swung up about a pivot into the angle of inclination, within a range of discrete angles, desired. A support arm under spring bias follows the movement of the keyboard as does a toothed segment, whose teeth encounter and rotatably deflect a pivotally mounted pawl against the bias of a spring. Upon release of the keyboard the deflected pawl engages a tooth on and positively locks the toothed segment against return movement, and its support arm thereby maintains the keyboard at the selected angle of inclination. The angles of inclination are discrete and depend on the width of the teeth on the toothed segment.

The radii of the toothed segment and pawl and the geometry is such that, over the arc of the segment, the pawl deflects to allow movement of the work surface upwardly from the starting horizontal or a previously selected smaller angle of inclination and precludes downward movement. Thus to select a lower angle of inclination requires a return to starting horizontal position which is simply accomplished by pivoting the work surface upwardly beyond the highest possible angle of inclination thereby to disengage the toothed segment and pawl. This will then allow downward pivoting motion of the toothed segment to starting position during which the toothed segment deflects and cams over the pawl, in a direction opposite that during the upward adjustment.

It is an object of the invention to provide mechanism to allow the angle of inclination of a work surface to be adjusted with a minimum of force and to be reliably and positively automatically locked at the selected angle of inclination.

Other objects, features and advantages of the present invention will become known to those skilled in the art from a reading of the following detailed description when taken in conjunction with the accompanying drawing wherein like reference numerals designate like or corresponding parts throughout the several views thereof, and wherein:

FIG. 1 is a front elevational view of a table with an inclination-adjustable keyboard;

FIG. 2 is a side elevational view of the table shown in FIG. 1;

Figure 3:
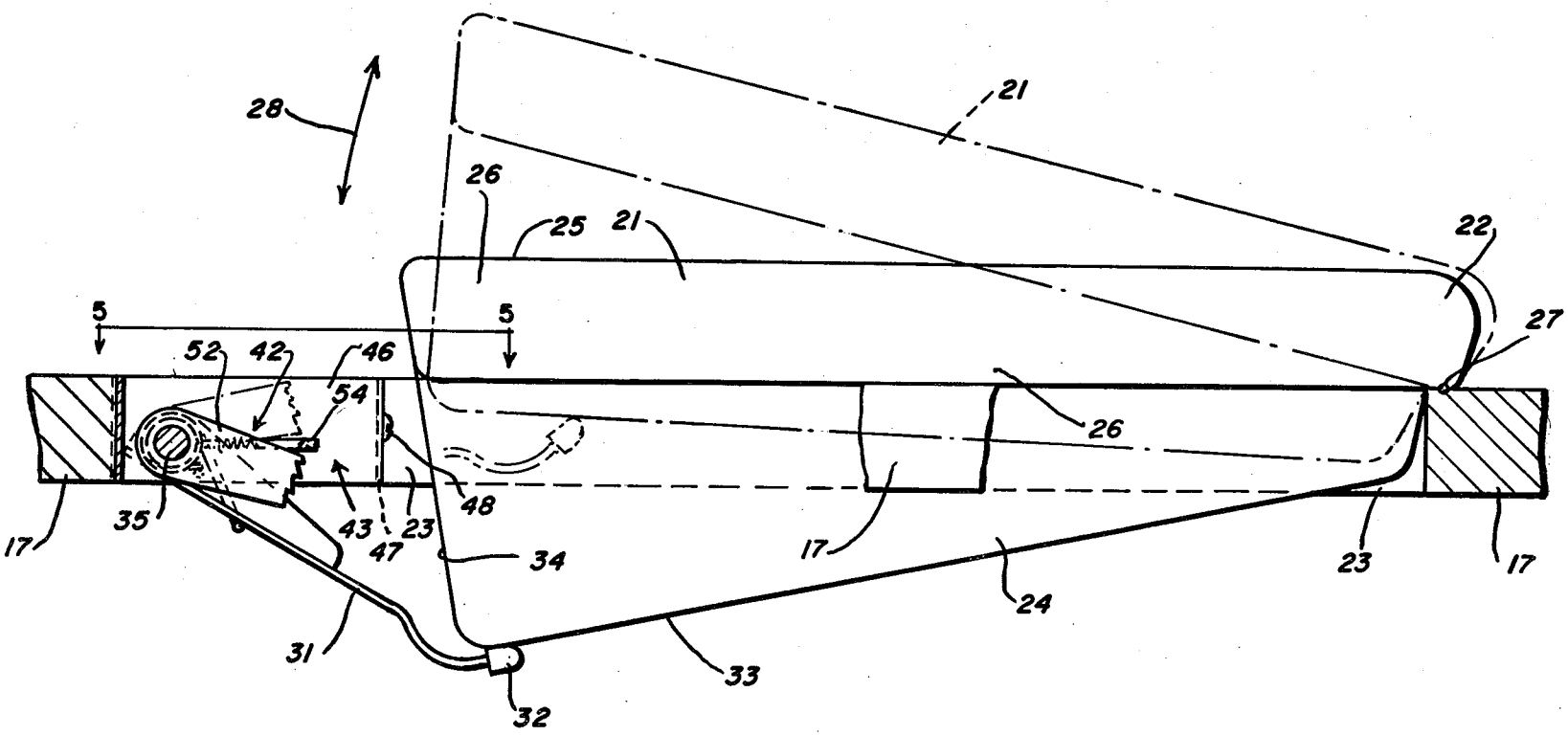
FIG. 3 is an enlarged fragmentary side elevational view of the keyboard showing the locking mechanism according to the invention.
Figure 4:
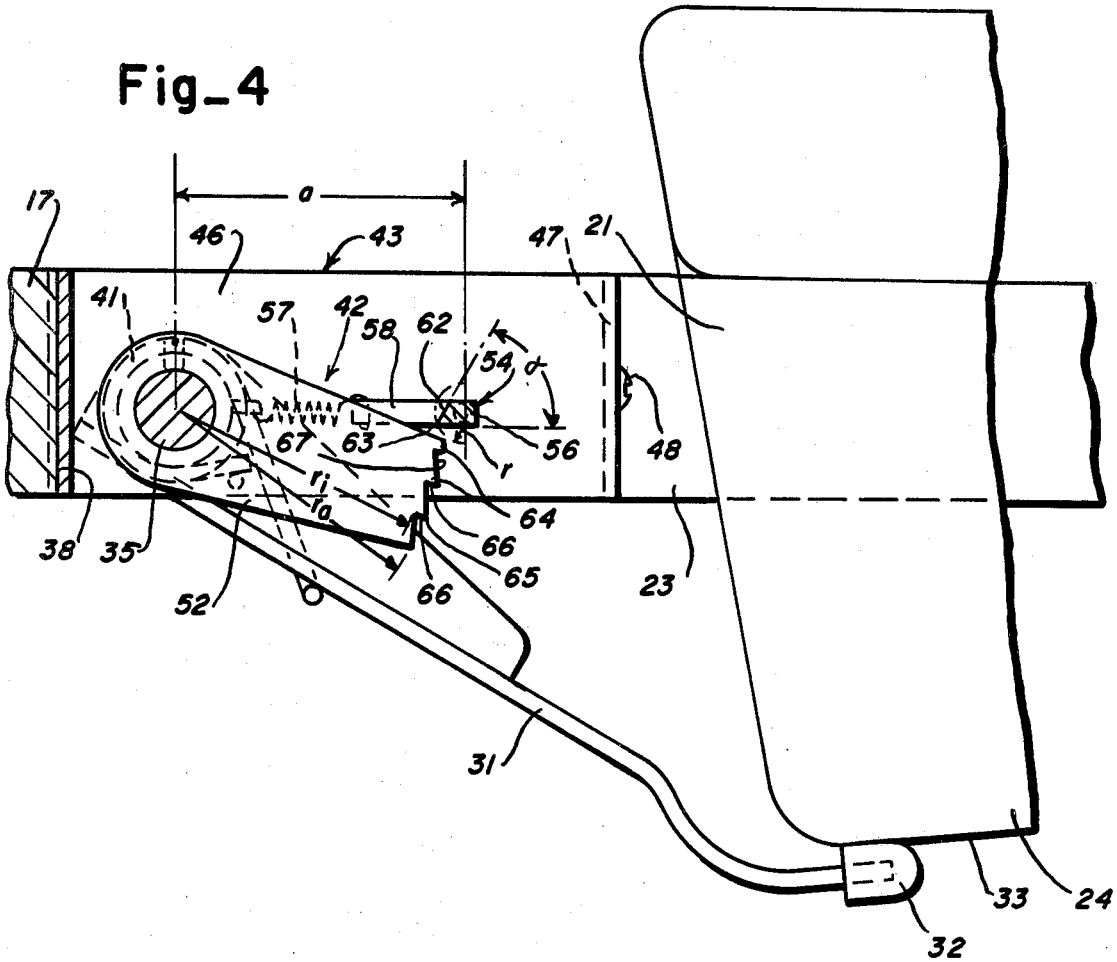
FIG. 4 is a side elevational view similar to FIG. 3, in larger scale, showing dimensional geometric relationships.
Figure 4A:
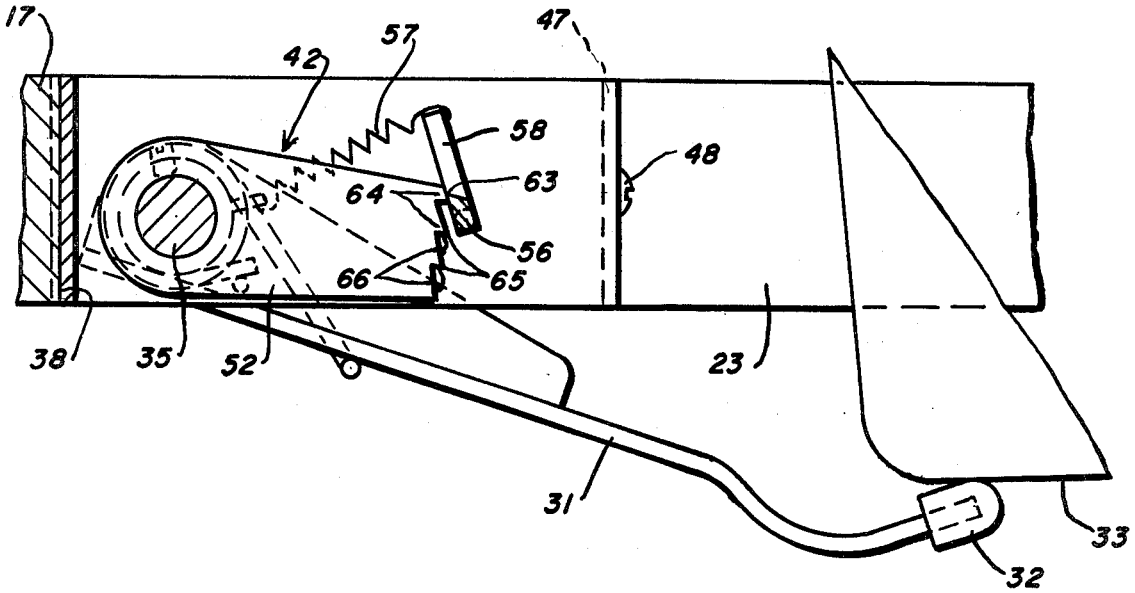
Figure 4B:
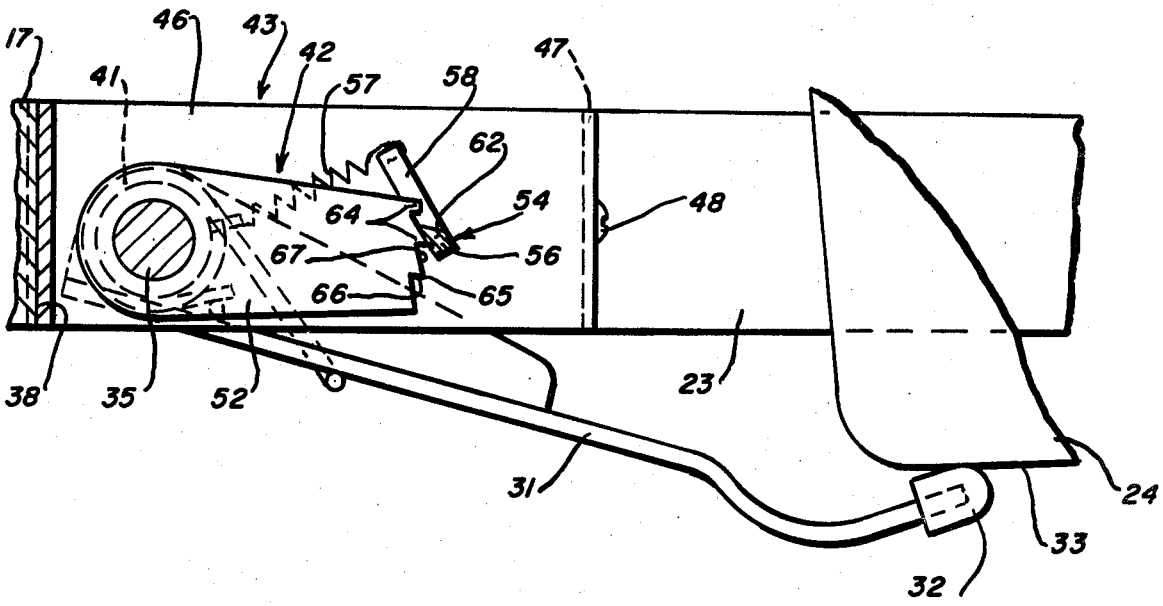
Figure 6:
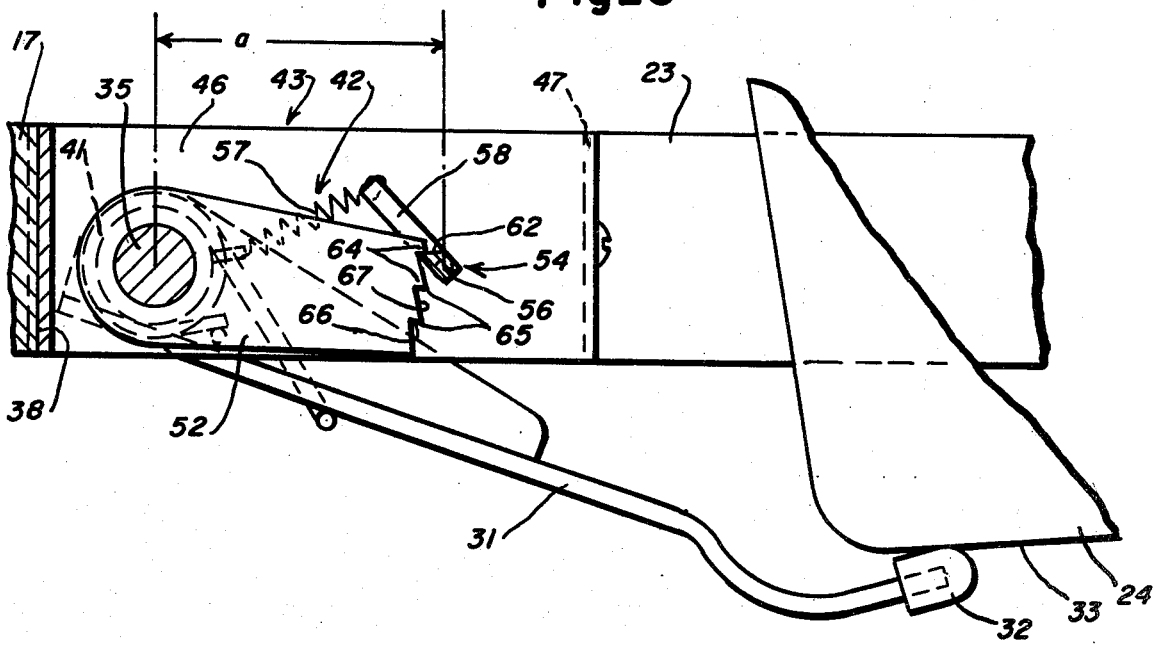

FIGS. 4*a* and 4*b* are active views of the mechanism;

FIG. 5 is a top elevational view of the mechanism taken along lines 5—5 of FIG. 3 with the work surface removed; and FIG. 6 is side elevational view similar to FIG. 3 with the mechanism shown locked at an angle of inclination.

Referring now to the drawing wherein like reference numerals designate like or corresponding parts throughout the several views there is shown in FIG. 1 a table generally designated by reference numeral 11 having a horizontal work platform 12 supported by side legs 13 resting on a floor surface 14. On the table work platform 12 a CRT Display Unit 15 is mounted for displaying information on its screen 16. A horizontal shelf 17, which may be supported on roller guides (not shown) secured to the inwardly facing sides of the side legs 13, is movable from a position beneath the table 11 to a pulled out operating position as shown in FIG. 2. The horizontal shelf 17 supports a work surface i.e. a keyboard, generally designated by reference numeral 21, below the level of the table top 12. With reference to FIGS. 2 and 3, the keyboard 21 is pivotally mounted adjacent its forward edge 22 to the shelf 17 for movement from a horizontal position to an inclined position, indicated in dotted lines in FIGS. 2 and 3. To accommodate a keyboard 21 which is wedge shaped and increasing in height from front to back as shown in FIG. 3, an opening 23 in the shelf 17 may be provided to receive the base portion 24 of the keyboard 21 as shown in FIG. 3, to enable the upper surface 25 of the wedged shaped keyboard 21 to be in a horizontal plane. To this end the upper side edges 26 of the keyboard 21 as shown in FIG. 1 will extend beyond the side walls of the opening 23 and rest on the upper surface of the shelf 17, thus defining a starting horizontal or reference position parallel to the table top 12.

As shown in FIG. 3, the underside of the forward portion 22 of the keyboard 21 is pivotally mounted as at 27 to the surface of the shelf 17 adjacent the front wall of the opening 17 whereby it can be raised and lowered about pivot 27 as indicated by arrow 28. With particular reference to FIG. 3 and to FIG. 5, the free ends of two support arms 31, which are covered by resilient buffers 32, engage and are biased against the underside 33 of the base portion 24 of the keyboard 21 adjacent the rear edge 34 thereof. The two support arms 31 are fixed to and mutually spaced on a shaft 34 whose ends extend into bearings 36 secured in the side walls 37 of the opening 23 in the shelf 17 toward the rear wall 38 thereof. One support arm 31, or both support arms 31 as shown in FIG. 5, are loaded by preloaded torsion springs 41 mounted about the shaft 35. The ends of the torsion spring 41 are connected at the side walls of the opening 23 of the shelf 17 and to the support arms 31 thereby to urge the support arms 31 toward the underside 33 of the keyboard 21. The torsion spring or springs 41 are not strong enough to overcome weight of and pivot the keyboard 21 upwardly about its pivot axis 27 in the direction of arrow 28, but are strong enough to bias the support arms 31 into firm contact with the underside 33 of the keyboard 21 and, to follow the keyboard 21 when it is pivoted upwardly by hand from the horizontal to a desired angle of inclination.

With further reference to FIG. 5 there is shown locking mechanism, generally designated by reference numeral 42, for locking the support arms 31 and supporting shaft 35 in different angular positions corresponding to selected angles of inclination of the keyboard 21. The locking mechanism 42 comprises a U-shaped frame generally designated by reference numberal 43 fitted within an opening 44 formed between projections 45 extending forwardly of the rear wall 38 of the opening 23 which accommodates the base portion 24 of the wedge shaped keyboard 21. As shown the shaft 35 extends across the opening 44 through the legs 46 of the frame 43 and through projections 45 and is rotatably supported thereby. The free ends 47 of the legs 46 of the U-shaped frame 43 are bent outwardly by 90° and, as by screws 48 are secured to the forwardly facing edges 51 of the projections 45.

With reference to FIGS. 3–6, a tooth segment 52 is fixed to shaft 35 between the two legs 46 of the frame 43 and parallel to them, i.e. perpendicular to the shaft 35, as by collars 53 and set screws. Also, a pawl, generally designated by reference numeal 54, is pivotally mounted in the spaced legs 46 of the frame 43 as by pins 55 so as to be pivotable about a pivot axis 56 forward of and parallel to the axis of shaft 35. A spring 57 connected at one end to a rearwardly extending pawl part 58 extends toward the rear wall 38 and its other end is suitably anchored to the shelf 17 so that, as shown in FIGS. 3 and 4 the pawl 54 is preloaded to assume a horizontal attitude parallel to the principal plane of the shelf 17. The pawl 54 has a notch 61 between extensions 58, to accomodate movement of the toothed segment 52 for interaction with the pawl 54 in a manner to be described.

With reference to FIG. 4, the pawl 54 has a locking face 62, inclined at an angle alpha, less than 90°, on the order of 60°, and its edge 63 is spaced from its pivot axis 56 by radius r. Also as viewed in FIG. 4 the toothed segment 52 is provided with several teeth 64 in the form of saw teeth, whose knife-edged tips 65 are located on an arc defined by a radius $r_a$ from the axis of shaft 35, whereas the respective roots of the teeth 64 lie on a circular arc defined by radius $r_1$ to the axis of the shaft 35. Each tooth 64 has a radially directed flank 66 and a flank 67 extending from the root of a tooth 64 to the tip 65 of a following tooth 64.

The distance, a, between the mutually parallel axes of the pawl 54 and shaft 35 is slightly, i.e. a few tenths of a millimeter, smaller than the sum of the radii $r_i+r$. With this geometry, when the keyboard 21 is raised upwardly about its pivot 27 from the position shown in FIG. 4, the support arms 31, shaft 35 and toothed segment 452 rotate as a unit counterclockwise under action of the torsion springs 41. As shown in FIG. 4*a* this causes the flank 67 of the uppermost tooth 64 of the segment 52 to encounter the edge 63 of the pawl 54 causing the pawl 54 to pivot upwardly or clockwise deflecting the extension spring 57. Continued movement will move the tip 65 of a segment tooth 64 past the edge 63 of the pawl 54. When this occurs the pawl 54 will be rotated back toward, but due to interfering arcs, short of its horizontal starting position by the extension spring 33, i.e. until, as shown in FIG. 4*b*, the pawl's edge 63 encounters the flank 67 of the next tooth 64. In the event the keyboard is released at this position, due to overlapping radii $r_i$ and r the pawl 54 forms a locking angle with the toothed segment 52 with the locking surface 62 resting against the respective radially extending flank 66 of a tooth 64 as shown in FIG. 5. Since the segment 52 is locked, the shaft 35 and the support arms 31 are also locked and serve to support the keyboard 21 at the angle of inclination selected. The number or range of inclined positions, into which the keyboard 21 can be maneuvered is established by the number of segment teeth 64.

In order to return the keyboard 21 into its roughly horizontal starting position it is pivoted up into the position shown in FIG. 3 in dash-dotted lines until the entire toothed segment 52, including all its teeth 64, is rotated out of the range of the pawl 54. In this position, the pawl 54 under the action of its spring 57 can assume its horizontal starting position. If the keyboard 21, and with it the support arms 31 and, via the shaft 35, the toothed segment 52 are pivoted downardly opposite to the direction of the pivot direction arrow 28, the roughly radially extending tooth flanks 66 of the teeth 64, will strike the obliquely extending pawl locking surface 62, and deflect the pawl 54 downwardly until the segment 52 is again out of the range of the pawl as shown in FIG. 4. From this position, a new angle of inclination can be selected.

The invention claimed is:

1. A work station support comprising a horizontal extending platform having an opening defining front, rear and side walls, a work station having an upper portion whose width is greater than the distance between said side walls, said work station being pivotally mounted on said platform adjacent the front wall of said opening for adjusting pivotal movement upwardly from a rest position at which the work station is supported on said platform to selected positions at which the work station is inclined relative to said horizontal platform, means for lockingly supporting said work station in a selected inclined position within a range of positions incident to its release following its upward pivoting movement to an inclined position, comprising a shaft rotatably mounted in opposite side walls of said platform opening with its axis parallel to said rear wall, a toothed segment and an arm secured to said shaft, said toothed segment extending into said opening at right angles to said shaft axis with its teeth directed toward said front wall, and said arm extending below said opening and underlying said work station, spring means mounted to rotatably bias said shaft whereby said arm is baised against the underside of said work station to follow said work station as it is moved from its rest position to an inclined position, the uppermost tooth of said tooth segment in the rest position of said work station being below a horizontal line, a pawl, a mounting means on said rear wall for pivotally supporting said pawl on an axis parallel to and spaced horizontally from the axis of said shaft and from the toothed end of said toothed segment, said pawl having a tooth extending towards the shaft axis for arrangement with the teeth of said toothed segment, and spring means for urging said pawl to a normal horizontal attitude above the uppermost tooth of the toothed segment whereby rotation of said shaft incident to pivoting upward movement of said work station will cause the toothed segment to deflect the pawl about its pivot axis and upon release of said work station will cause said pawl tooth to engage a segment tooth to thereby arrest return movement of said tooth segment and said arm whereby said work station will be supported at a selected inclination by said arm.

2. A work station support as recited in claim 1, the distance between the shaft axis and the pawl pivot axis being less than the sum of the radius from the shaft axis to roots of the teeth of the tooth segment and the radius from the pawl pivot axis to the tip of the pawl tooth whereby the pawl at deflected positions above the horizontal will form a locking angle with a tooth of the toothed segment.

3. A work station as recited in claim 2, the flanks of said segment teeth between the root and crest lying on a radial line from the shaft axis, and said pawl tooth having an inclined locking surface for engagement with said flanks.

4. A work station as recited in claim 3, said distance between root and crests of said teeth of said segment being such that the pawl will be deflected by the teeth of said toothed segment during movement of said work station to rest position following upward movement of the work station and the toothed segment out of the range of the pawl.

* * * * *

UNITED STATES PATENT AND TRADEMARK OFFICE

CERTIFICATE OF CORRECTION

PATENT NO. : 4,421,035
DATED : December 20, 1983
INVENTOR(S) : Bernd Gubbe, et al It is certified that error appears in the above-identified patent and that said Letters Patent are hereby corrected as shown below:

Col. 1, line 28 - insert the word "table" before "tops".

Col. 2, line 62 - "34" should be 35.
line 68 - "at" should be to.

Col. 3, line 32 - "numeal" should be numeral.
line 63 - "452" should be 52.

Col. 4, line 11 - "Fig. 5" should be Fig. 6.
line 26 - "downardly" should be downwardly.

IN THE CLAIMS
Col. 5, line 6,
Claim 1, line 40 - the word "arrangement" should be engagement.

Signed and Sealed this

Twenty-second Day of May 1984

[SEAL]

Attest:

GERALD J. MOSSINGHOFF

Attesting Officer

Commissioner of Patents and Trademarks